US008308162B2

(12) United States Patent
Rogers

(10) Patent No.: US 8,308,162 B2
(45) Date of Patent: Nov. 13, 2012

(54) COMBINATION SCRATCH TICKET AND ON-LINE GAME TICKET

(75) Inventor: Stephen Kyle Rogers, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 42 days.

(21) Appl. No.: 12/648,963

(22) Filed: Dec. 29, 2009

(65) Prior Publication Data

US 2010/0102546 A1 Apr. 29, 2010

Related U.S. Application Data

(62) Division of application No. 11/436,166, filed on May 17, 2006, now Pat. No. 7,654,529.

(51) Int. Cl.
*A63B 71/00* (2006.01)

(52) U.S. Cl. ..... 273/139; 463/18; 463/19; 463/20; 273/143 R

(58) Field of Classification Search ..... None
See application file for complete search history.

(56) References Cited

U.S. PATENT DOCUMENTS

| | | | | |
|---|---|---|---|---|
| 1,527,929 | A | | 2/1925 | Simons |
| 3,089,123 | A | | 5/1963 | Hennis et al. |
| 3,245,697 | A | | 4/1966 | BNugent |
| 3,699,311 | A | | 10/1972 | Dunbar |
| 3,736,368 | A | | 5/1973 | Vogelman et al. |
| 3,826,499 | A | | 7/1974 | Lenkoff |
| 3,868,057 | A | | 2/1975 | Chavez |
| 3,876,865 | A | | 4/1975 | Bliss |
| 3,902,253 | A | | 9/1975 | Sabuzawa et al. |
| 3,918,174 | A | | 11/1975 | Miller et al. |
| 3,922,529 | A | | 11/1975 | Orloff |
| 3,925,585 | A | * | 12/1975 | Aoyagi ..... 428/42.3 |
| 3,934,120 | A | | 1/1976 | Maymarev |
| 4,017,834 | A | | 4/1977 | Cuttill et al. |
| 4,095,824 | A | | 6/1978 | Bachman |
| 4,105,156 | A | | 8/1978 | Dethloff |
| 4,176,406 | A | | 11/1979 | Matkan |
| 4,191,376 | A | | 3/1980 | Goldman et al. |
| 4,194,296 | A | | 3/1980 | Pagnozzi et al. |
| 4,195,772 | A | | 4/1980 | Nishimura |
| 4,206,920 | A | | 6/1980 | Weatherford et al. |

(Continued)

FOREIGN PATENT DOCUMENTS

AU B-18428/92 12/1992

(Continued)

OTHER PUBLICATIONS

Chip Brown, 'Austin American-Statesman', (Article), May 28, 1998, 2 Pgs., Texas.

John C. Hallyburton, Jr., 'Frequently Asked Questions About Keno', (Internet Article),1995, 1998, 10 Pgs., (http://conicelco.com/faq/keno.html).

(Continued)

*Primary Examiner* — Alvin Hunter
*Assistant Examiner* — Dolores Collins
(74) *Attorney, Agent, or Firm* — Dority & Manning, P.A.

(57) ABSTRACT

A system and method for implementing a secondary lottery game with a first instant lottery game in an instant lottery game ticket is disclosed. The player purchases an instant lottery game, where chances for winning instant prizes are provided to the player. The player may also be provided a chance to win entry with predetermined entry indicia into a secondary lottery game if the instant lottery ticket indicates that the player has won a ticket to the secondary lottery game.

9 Claims, 7 Drawing Sheets

U.S. PATENT DOCUMENTS

| | | | | | |
|---|---|---|---|---|---|
| 4,241,942 | A | | 12/1980 | Bachman | |
| 4,243,216 | A | | 1/1981 | Mazumder | |
| 4,273,362 | A | | 6/1981 | Carrier et al. | |
| 4,309,452 | A | | 1/1982 | Sachs | |
| 4,313,087 | A | | 1/1982 | Weitzen et al. | |
| 4,355,300 | A | | 10/1982 | Weber | |
| 4,375,666 | A | | 3/1983 | Buck et al. | |
| 4,398,708 | A | | 8/1983 | Goldman et al. | |
| 4,407,443 | A | | 10/1983 | McCorkle | |
| 4,451,759 | A | | 5/1984 | Heynisch | |
| 4,455,039 | A | | 6/1984 | Weitzen et al. | |
| 4,457,430 | A | | 7/1984 | Darling et al. | |
| 4,464,423 | A | | 8/1984 | LaBianca et al. | |
| 4,466,614 | A | | 8/1984 | Bachman et al. | |
| 4,488,646 | A | | 12/1984 | McCorkle | |
| 4,491,319 | A | | 1/1985 | Nelson | |
| 4,494,197 | A | | 1/1985 | Troy et al. | |
| 4,536,218 | A | | 8/1985 | Ganho | |
| 4,544,184 | A | | 10/1985 | Freund et al. | |
| 4,579,371 | A | | 4/1986 | Long et al. | |
| 4,591,189 | A | | 5/1986 | Holmen et al. | |
| 4,634,149 | A | | 1/1987 | Donovan | |
| 4,665,502 | A | | 5/1987 | Kreisner | |
| 4,669,729 | A | | 6/1987 | Solitt et al. | |
| 4,689,742 | A | | 8/1987 | Troy et al. | |
| 4,726,608 | A | | 2/1988 | Walton | |
| 4,736,109 | A | | 4/1988 | Dvorzsak | |
| 4,740,016 | A | * | 4/1988 | Konecny et al. | 273/139 |
| 4,760,247 | A | | 7/1988 | Keane et al. | |
| 4,763,927 | A | | 8/1988 | Schneider | |
| 4,775,155 | A | | 10/1988 | Lees | |
| 4,792,667 | A | | 12/1988 | Chen | |
| 4,805,907 | A | | 2/1989 | Hagiwara | |
| 4,817,951 | A | | 4/1989 | Crouch et al. | |
| 4,832,341 | A | * | 5/1989 | Muller et al. | 463/17 |
| 4,835,624 | A | | 5/1989 | Black et al. | |
| 4,836,546 | A | | 6/1989 | DiRe et al. | |
| 4,836,553 | A | | 6/1989 | Suttle et al. | |
| 4,837,728 | A | | 6/1989 | Barrie et al. | |
| 4,856,787 | A | | 8/1989 | Itkis | |
| 4,861,041 | A | | 8/1989 | Jones et al. | |
| 4,870,260 | A | | 9/1989 | Niepolomski et al. | |
| 4,880,964 | A | | 11/1989 | Donahue | |
| 4,888,964 | A | | 12/1989 | Klinge | |
| 4,922,522 | A | | 5/1990 | Scanlon | |
| 4,943,090 | A | * | 7/1990 | Fienberg | 273/139 |
| 4,960,611 | A | | 10/1990 | Fujisawa et al. | |
| 4,961,578 | A | | 10/1990 | Chateau | |
| 4,964,642 | A | | 10/1990 | Kamille | |
| 4,996,705 | A | | 2/1991 | Entenmann et al. | |
| 4,998,010 | A | | 3/1991 | Chandler et al. | |
| 4,998,199 | A | | 3/1991 | Tashiro et al. | |
| 5,007,641 | A | * | 4/1991 | Seidman | 463/17 |
| 5,032,708 | A | | 7/1991 | Comerford et al. | |
| 5,037,099 | A | | 8/1991 | Burtch | |
| 5,046,737 | A | * | 9/1991 | Fienberg | 273/139 |
| 5,074,566 | A | | 12/1991 | Desbiens | |
| 5,083,815 | A | | 1/1992 | Scrymgeour et al. | |
| 5,092,598 | A | * | 3/1992 | Kamille | 273/139 |
| 5,094,458 | A | | 3/1992 | Kamille | |
| 5,100,139 | A | | 3/1992 | Di Bella | |
| 5,109,153 | A | | 4/1992 | Johnsen et al. | |
| 5,112,050 | A | | 5/1992 | Koza et al. | |
| 5,116,049 | A | | 5/1992 | Sludikoff et al. | |
| 5,118,109 | A | | 6/1992 | Gumina | |
| 5,119,295 | A | | 6/1992 | Kapur | |
| 5,158,293 | A | * | 10/1992 | Mullins | 273/139 |
| 5,165,967 | A | | 11/1992 | Theno et al. | |
| 5,186,463 | A | | 2/1993 | Marin et al. | |
| 5,189,292 | A | | 2/1993 | Batterman et al. | |
| 5,193,815 | A | | 3/1993 | Pollard | |
| 5,193,854 | A | | 3/1993 | Borowski, Jr. et al. | |
| 5,228,692 | A | | 7/1993 | Carrick et al. | |
| 5,232,221 | A | | 8/1993 | Sludikoff et al. | |
| 5,234,798 | A | | 8/1993 | Heninger et al. | |
| 5,249,801 | A | | 10/1993 | Jarvis | |
| 5,259,616 | A | | 11/1993 | Bergmann | |
| 5,273,281 | A | | 12/1993 | Lovell | |
| 5,276,980 | A | | 1/1994 | Carter et al. | |
| 5,282,620 | A | | 2/1994 | Keesee | |
| 5,308,992 | A | | 5/1994 | Crane et al. | |
| 5,317,135 | A | | 5/1994 | Finocchio | |
| 5,326,104 | A | | 7/1994 | Pease et al. | |
| 5,332,219 | A | | 7/1994 | Marnell, II et al. | |
| 5,342,047 | A | | 8/1994 | Heidel et al. | |
| 5,342,049 | A | | 8/1994 | Wichinsky et al. | |
| 5,344,144 | A | | 9/1994 | Canon | |
| 5,346,258 | A | | 9/1994 | Behm et al. | |
| 5,380,007 | A | | 1/1995 | Travis et al. | |
| 5,393,057 | A | | 2/1995 | Marnell, II et al. | |
| 5,401,024 | A | | 3/1995 | Simunek | |
| 5,401,541 | A | | 3/1995 | Hodnett, III | |
| 5,403,039 | A | | 4/1995 | Borowski, Jr. et al. | |
| 5,407,199 | A | * | 4/1995 | Gumina | 273/139 |
| 5,407,200 | A | * | 4/1995 | Zalabak | 273/139 |
| 5,420,406 | A | | 5/1995 | Izawa et al. | |
| 5,432,005 | A | | 7/1995 | Tanigami et al. | |
| 5,451,052 | A | | 9/1995 | Behm et al. | |
| 5,456,465 | A | | 10/1995 | Durham | |
| 5,456,602 | A | | 10/1995 | Sakuma | |
| 5,471,040 | A | | 11/1995 | May | |
| 5,475,205 | A | | 12/1995 | Behm et al. | |
| 5,486,005 | A | | 1/1996 | Neal | |
| 5,513,846 | A | | 5/1996 | Niederlein et al. | |
| 5,528,154 | A | | 6/1996 | Leichner et al. | |
| 5,536,016 | A | | 7/1996 | Thompson | |
| 5,540,442 | A | | 7/1996 | Orselli et al. | |
| 5,548,110 | A | | 8/1996 | Storch et al. | |
| 5,550,746 | A | | 8/1996 | Jacobs | |
| 5,560,610 | A | | 10/1996 | Behm et al. | |
| 5,564,700 | A | | 10/1996 | Celona | |
| 5,564,977 | A | | 10/1996 | Algie | |
| 5,591,956 | A | | 1/1997 | Longacre, Jr. et al. | |
| 5,599,046 | A | | 2/1997 | Behm et al. | |
| 5,602,381 | A | | 2/1997 | Hoshino et al. | |
| 5,621,200 | A | | 4/1997 | Irwin et al. | |
| 5,628,684 | A | | 5/1997 | Bouedec | |
| 5,630,753 | A | | 5/1997 | Fuchs | |
| 5,647,592 | A | * | 7/1997 | Gerow | 273/139 |
| 5,651,735 | A | | 7/1997 | Baba | |
| 5,655,961 | A | | 8/1997 | Acres et al. | |
| 5,657,991 | A | * | 8/1997 | Camarato | 273/269 |
| 5,667,250 | A | | 9/1997 | Behm et al. | |
| 5,682,819 | A | | 11/1997 | Beaty | |
| 5,690,366 | A | | 11/1997 | Luciano | |
| 5,704,647 | A | | 1/1998 | Desbiens | |
| 5,722,891 | A | | 3/1998 | Inoue | |
| 5,726,898 | A | | 3/1998 | Jacobs | |
| 5,732,948 | A | | 3/1998 | Yoseloff | |
| 5,741,183 | A | | 4/1998 | Acres et al. | |
| 5,743,800 | A | | 4/1998 | Huard et al. | |
| 5,752,882 | A | | 5/1998 | Acres et al. | |
| 5,756,220 | A | | 5/1998 | Hoshino et al. | |
| 5,768,142 | A | | 6/1998 | Jacobs | |
| 5,769,458 | A | | 6/1998 | Carides et al. | |
| 5,770,533 | A | | 6/1998 | Franchi | |
| 5,772,509 | A | | 6/1998 | Weiss | |
| 5,772,510 | A | | 6/1998 | Roberts | |
| 5,772,511 | A | | 6/1998 | Smeltzer | |
| RE35,864 | E | | 7/1998 | Weingardt | |
| 5,779,840 | A | | 7/1998 | Boris | |
| 5,789,459 | A | | 8/1998 | Inagaki et al. | |
| 5,791,990 | A | | 8/1998 | Schroeder et al. | |
| 5,797,794 | A | | 8/1998 | Angell | |
| 5,803,504 | A | | 9/1998 | Deshiens et al. | |
| 5,816,920 | A | | 10/1998 | Hanai | |
| 5,818,019 | A | | 10/1998 | Irwin, Jr. et al. | |
| 5,820,459 | A | | 10/1998 | Acres et al. | |
| 5,823,874 | A | | 10/1998 | Adams | |
| 5,830,063 | A | | 11/1998 | Byrne | |
| 5,830,066 | A | | 11/1998 | Goden et al. | |
| 5,830,067 | A | | 11/1998 | Graves et al. | |
| 5,833,537 | A | | 11/1998 | Barrie | |
| 5,835,576 | A | | 11/1998 | Katz et al. | |
| 5,836,086 | A | | 11/1998 | Elder | |
| 5,836,817 | A | | 11/1998 | Acres et al. | |
| 5,848,932 | A | | 12/1998 | Adams | |

| | | | | |
|---|---|---|---|---|
| 5,863,075 | A | 1/1999 | Rich et al. | |
| 5,871,398 | A | 2/1999 | Schneier et al. | |
| 5,876,284 | A | 3/1999 | Acres et al. | |
| 5,882,261 | A | 3/1999 | Adams | |
| 5,883,537 | A | 3/1999 | Luoni et al. | |
| 5,885,158 | A | 3/1999 | Torango et al. | |
| 5,887,906 | A | 3/1999 | Sultan | |
| 5,903,340 | A | 5/1999 | Lawandy et al. | |
| 5,911,418 | A | 6/1999 | Adams | |
| 5,915,588 | A | 6/1999 | Stoken et al. | |
| 5,934,671 | A * | 8/1999 | Harrison | 273/139 |
| 5,970,143 | A | 10/1999 | Schneier et al. | |
| 5,979,894 | A | 11/1999 | Alexoff | |
| 5,996,997 | A | 12/1999 | Kamille | |
| 5,997,044 | A | 12/1999 | Behm et al. | |
| 6,003,307 | A | 12/1999 | Naber et al. | |
| 6,004,207 | A | 12/1999 | Wilson, Jr. et al. | |
| 6,004,208 | A | 12/1999 | Takemoto et al. | |
| 6,007,162 | A | 12/1999 | Hinz et al. | |
| 6,012,982 | A | 1/2000 | Piechowiak et al. | |
| 6,014,032 | A | 1/2000 | Maddix et al. | |
| 6,017,032 | A | 1/2000 | Grippo et al. | |
| 6,019,032 | A * | 2/2000 | Arksey | 99/452 |
| 6,024,641 | A | 2/2000 | Sarno | |
| 6,053,405 | A | 4/2000 | Irwin, Jr. et al. | |
| 6,077,162 | A | 6/2000 | Weiss | |
| 6,080,062 | A | 6/2000 | Olson | |
| 6,086,477 | A | 7/2000 | Walker et al. | |
| 6,089,978 | A | 7/2000 | Adams | |
| 6,099,407 | A | 8/2000 | Parker, Jr. et al. | |
| 6,102,400 | A | 8/2000 | Scott et al. | |
| 6,107,913 | A | 8/2000 | Gatto et al. | |
| 6,119,364 | A | 9/2000 | Elder | |
| 6,125,368 | A | 9/2000 | Bridge et al. | |
| 6,142,872 | A | 11/2000 | Walker et al. | |
| 6,146,272 | A | 11/2000 | Walker et al. | |
| 6,149,521 | A | 11/2000 | Sanduski | |
| 6,155,491 | A | 12/2000 | Dueker et al. | |
| 6,168,521 | B1 | 1/2001 | Luciano et al. | |
| 6,168,522 | B1 | 1/2001 | Walker et al. | |
| 6,179,710 | B1 | 1/2001 | Sawyer et al. | |
| 6,203,430 | B1 | 3/2001 | Walker et al. | |
| 6,206,373 | B1 | 3/2001 | Garrod | |
| 6,210,275 | B1 | 4/2001 | Olsen | |
| 6,217,448 | B1 | 4/2001 | Olsen | |
| 6,220,961 | B1 * | 4/2001 | Keane et al. | 463/16 |
| 6,224,055 | B1 | 5/2001 | Walker et al. | |
| 6,227,969 | B1 | 5/2001 | Yoseloff | |
| 6,238,288 | B1 | 5/2001 | Walker et al. | |
| 6,309,298 | B1 * | 10/2001 | Gerow | 463/20 |
| 6,309,300 | B1 | 10/2001 | Glavich | |
| 6,312,334 | B1 | 11/2001 | Yoseloff | |
| 6,315,291 | B1 | 11/2001 | Moody | |
| 6,330,976 | B1 | 12/2001 | Dymetman et al. | |
| 6,331,143 | B1 | 12/2001 | Yoseloff | |
| 6,334,814 | B1 | 1/2002 | Adams | |
| 6,340,158 | B2 | 1/2002 | Pierce et al. | |
| 6,368,213 | B1 | 4/2002 | McNabola | |
| 6,375,568 | B1 | 4/2002 | Roffman et al. | |
| 6,379,742 | B1 | 4/2002 | Behm et al. | |
| 6,394,899 | B1 | 5/2002 | Walker et al. | |
| 6,398,214 | B1 | 6/2002 | Moteki et al. | |
| 6,398,643 | B1 | 6/2002 | Knowles et al. | |
| 6,398,644 | B1 | 6/2002 | Perrie et al. | |
| 6,398,645 | B1 | 6/2002 | Yoseloff | |
| 6,416,408 | B2 | 7/2002 | Tracy et al. | |
| 6,419,579 | B1 | 7/2002 | Bennett | |
| 6,435,408 | B1 | 8/2002 | Irwin, Jr. et al. | |
| 6,435,500 | B2 | 8/2002 | Gumina | |
| 6,478,677 | B1 | 11/2002 | Moody | |
| 6,488,280 | B1 * | 12/2002 | Katz et al. | 273/138.1 |
| 6,491,215 | B1 * | 12/2002 | Irwin et al. | 235/375 |
| 6,497,408 | B1 * | 12/2002 | Walker et al. | 273/138.1 |
| 6,552,290 | B1 | 4/2003 | Lawandy | |
| 6,565,084 | B1 * | 5/2003 | Katz et al. | 273/138.1 |
| 6,220,596 | B1 | 7/2003 | Walker et al. | |
| 6,588,747 | B1 | 7/2003 | Seelig | |
| 6,599,186 | B1 | 7/2003 | Walker et al. | |
| 6,601,772 | B1 | 8/2003 | Rubin et al. | |
| 6,637,747 | B1 | 10/2003 | Garrod | |
| 6,648,735 | B2 | 11/2003 | Miyashita et al. | |
| 6,648,753 | B1 | 11/2003 | Tracy et al. | |
| 6,648,755 | B1 | 11/2003 | Luciano et al. | |
| 6,676,126 | B1 | 1/2004 | Walker et al. | |
| 6,692,354 | B2 | 2/2004 | Tracy et al. | |
| 6,702,047 | B2 | 3/2004 | Huber | |
| 6,773,345 | B2 | 8/2004 | Walker et al. | |
| 6,776,337 | B2 | 8/2004 | Irwin, Jr. et al. | |
| 6,786,824 | B2 | 9/2004 | Cannon | |
| 6,811,484 | B2 * | 11/2004 | Katz et al. | 463/17 |
| 6,823,874 | B2 | 11/2004 | Lexcen | |
| 6,875,105 | B1 | 4/2005 | Behm et al. | |
| 6,929,186 | B2 | 8/2005 | Lapstun | |
| 7,322,885 | B1 * | 1/2008 | Luciano et al. | 463/17 |
| 7,490,830 | B2 * | 2/2009 | Mirandette et al. | 273/139 |
| 7,654,529 | B2 * | 2/2010 | Rogers | 273/139 |
| 7,740,243 | B1 * | 6/2010 | Kean | 273/139 |
| 2001/0019193 | A1 * | 9/2001 | Gumina | 273/139 |
| 2001/0027130 | A1 | 10/2001 | Namba et al. | |
| 2001/0030978 | A1 | 10/2001 | Holloway et al. | |
| 2001/0034262 | A1 | 10/2001 | Banyai | |
| 2001/0040345 | A1 | 11/2001 | Au-Yeung | |
| 2002/0022511 | A1 | 2/2002 | Eklund et al. | |
| 2002/0084335 | A1 | 7/2002 | Ericson | |
| 2002/0171201 | A1 | 11/2002 | Au-Yeung | |
| 2002/0187825 | A1 | 12/2002 | Tracy et al. | |
| 2003/0050109 | A1 | 3/2003 | Caro et al. | |
| 2003/0060257 | A1 * | 3/2003 | Katz et al. | 463/16 |
| 2003/0060261 | A1 * | 3/2003 | Katz et al. | 463/17 |
| 2003/0102625 | A1 * | 6/2003 | Katz et al. | 273/138.1 |
| 2003/0114210 | A1 | 6/2003 | Meyer et al. | |
| 2004/0076310 | A1 | 4/2004 | Hersch et al. | |
| 2004/0173965 | A1 | 9/2004 | Stanek | |
| 2004/0178582 | A1 | 9/2004 | Garrod | |
| 2004/0185931 | A1 | 9/2004 | Lowell et al. | |
| 2004/0204222 | A1 | 10/2004 | Roberts | |
| 2004/0259631 | A1 | 12/2004 | Katz et al. | |
| 2004/0266514 | A1 | 12/2004 | Penrice | |
| 2005/0096117 | A1 * | 5/2005 | Katz et al. | 463/17 |
| 2006/0012116 | A1 * | 1/2006 | Lovell | 273/138.1 |
| 2006/0205476 | A1 * | 9/2006 | Jubinville | 463/17 |
| 2008/0015007 | A1 * | 1/2008 | O'Brien | 463/17 |
| 2008/0220840 | A1 * | 9/2008 | Katz et al. | 463/16 |
| 2009/0280886 | A1 * | 11/2009 | Randhawa | 463/17 |

FOREIGN PATENT DOCUMENTS

| | | |
|---|---|---|
| AU | B-21070/92 | 7/1993 |
| AU | A-50327/96 | 2/1997 |
| AU | B-52499/96 | 2/1997 |
| AU | 199716432 | 9/1997 |
| AU | A-45403/97 | 4/1998 |
| AU | A-63553/98 | 10/1998 |
| DE | 2938307 | 4/1981 |
| DE | 3035898 | 4/1982 |
| DE | 3035947 | 5/1982 |
| DE | 2938307 | 6/1982 |
| DE | 3822636 | 1/1990 |
| DE | 2938307 | 8/1990 |
| DE | 3822636 | 1/1992 |
| DE | 3415114 | 10/1995 |
| DE | 19646956 | 5/1998 |
| DE | 19706286 | 5/1998 |
| DE | 29803107 | 9/1998 |
| DE | 29816453 | 4/1999 |
| DE | 19751746 | 5/1999 |
| EP | 0122902 | 4/1984 |
| EP | 0333934 | 9/1989 |
| EP | 0458623 | 11/1991 |
| EP | 0798676 | 10/1997 |
| EP | 0799649 | 10/1997 |
| EP | 0149712 | 7/1998 |
| EP | 0874337 | 10/1998 |
| EP | 0896304 | 2/1999 |
| EP | 0914875 | 5/1999 |
| EP | 0919965 | 6/1999 |
| EP | 0983801 | 3/2000 |
| EP | 0983801 | 3/2001 |
| EP | 1149712 | 10/2001 |

| | | |
|---|---|---|
| ES | 529535 | 6/1983 |
| ES | 529536 | 6/1983 |
| ES | 2006400 | 4/1989 |
| ES | 2006401 | 4/1989 |
| GB | 642892 | 9/1950 |
| GB | 2075918 | 11/1981 |
| GB | 2222712 | 3/1990 |
| GB | 2230373 | 10/1990 |
| GB | 2295775 | 12/1996 |
| GB | 3328311 | 2/1999 |
| GB | 23282311 | 2/1999 |
| JP | 02235744 | 9/1990 |
| JP | 04132672 | 5/1992 |
| WO | WO85/02250 | 5/1985 |
| WO | WO91/17529 | 11/1991 |
| WO | WO 98/03910 | 1/1998 |
| WO | WO 98/40138 | 9/1998 |
| WO | WO 99/09364 | 2/1999 |
| WO | WO 99/26204 | 5/1999 |
| WO | WO 99/39312 | 8/1999 |
| WO | WO00/00256 | 1/2000 |
| WO | WO00/78418 | 12/2000 |
| WO | WO01/74460 | 11/2001 |
| WO | WO01/93966 | 12/2001 |
| WO | WO02/056266 | 7/2002 |

OTHER PUBLICATIONS

Judith Gaines, 'Pool Party Betting Business Booming Throughout Area Workplaces', (Internet Article), Mar. 19, 1994, 2 Pgs., Issue 07431791, Boston Globe, Boston, MA.

'Notice of Final Rulemaking', (Internet Article) Mar. 24, 2000, 10 Pgs., vol. 6, Issue #13, Arizona Adminstration Register, Arizona.

'How to Play Megabucks', (Internet Article), Mar. 9, 2001, 2 Pgs., Oregon Lottery Megabucks,(http://www.oregonlottery.org.mega/m.sub.—howto.htm).

'How to Play Megabucks', (Internet Article), May 8, 2001, 2 Pgs., Oregon Lottery Megabucks, (http://www.oregonlottery.org/mega/m.sub.—howto.htm).

'Oregon Lottery', (Internet Article), Apr. 30, 2004, 9 Pgs., Oregon Lottery Web Center, (http://www.oregonlottery.org/general/g.sub.—hist.shtml).

'Powerball Odd & Prizes', 'How to Play Powerball', (Internet Article), Dec. 2002, 2 Pgs., (www.powerball.com/pbhowtoplay.shtm).

Mike Parker, 'The History of Horse Racing' (Internet Article), 1996,1997, 1998, 5 Pgs., http://www.mrmike.com/explore/hrhist.htm

* cited by examiner

300

State Lottery

FORTUNE COOKIE

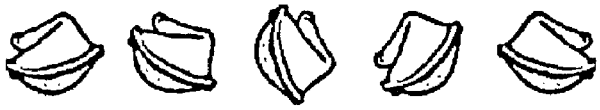

Match any of YOUR NUMBERS to either one of the LUCKY NUMBERS, win prize for that number. Reveal a "吉" symbol in the LUCKY FORTUNE, immediately win all 10 prizes!

304

| LUCKY NUMBERS | |
|---|---|
| 6 | 15 |
| six | fifteen |

| LUCKY FORTUNE NUMBERS |
|---|
| 12 36 4 15 22 9 |

YOUR NUMBERS

| | | | | |
|---|---|---|---|---|
| 6 | 11 | 20 | 8 | 14 |
| six | eleven | twenty | eight | fourteen |
| $20 | $10 | $5 | $100 | |
| twenty | ten | five | one hundred | TICKET |
| 1 | 18 | 12 | 7 | 10 |
| one | eighteen | twelve | seven | tem |
| $7 | $10 | $2 | $1000 | $1 |
| seven | ten | two | one thousand | one |

FIG. 3

500

INSTANT PICK 3

- If any of YOUR NUMBERS match the LOTTERY NUMBERS in any of the way shown in the prize grid for that game, win that prize amount.
- Get a "" in the BONUS BOX and double the prize amount won for that game.

2nd DIGIT 5 FIVE

1st DIGIT 2 TWO

3rd DIGIT 9 NINE

LOTTERY NUMBERS

MATCH

| | |
|---|---|
| All 3 digits in exact order | $ 10,000 |
| All 3 digits in any order | $ 500 |
| 1st and 2nd digits in exact order | $ 40 |
| Last 2 digits in exact order | $ 30 |
| 1st digit only | $ 4 |
| 2nd digit only | $ 2 |
| 3rd digit only | $ 1 |

| | YOUR NUMBERS | |
|---|---|---|
| GAME 1 | 1 one, 8 eight, 7 seven | PLAY AGAIN |
| GAME 2 | 3 three, 6 six, 7 seven | |
| GAME 3 | 3 three, 4 four, 8 eight | ENTRY |
| GAME 4 | 6 six, 7 seven, 1 one | PLAY AGAIN |

WIN UP TO $10,000!

FIG. 5

600

INSTANT PICK 3

- If any of YOUR NUMBERS match the LOTTERY NUMBERS in any of the way shown in the prize grid for that game, win that prize amount.
- Get a "" in the BONUS BOX and double the prize amount won for that game.

2nd DIGIT 5 FIVE

1st DIGIT 2 TWO

3rd DIGIT 9 NINE

LOTTERY NUMBERS

MATCH

| | |
|---|---|
| All 3 digits in exact order | $ 10,000 |
| All 3 digits in any order | $ 500 |
| 1st and 2nd digits in exact order | $ 40 |
| Last 2 digits in exact order | $ 30 |
| 1st digit only | $ 4 |
| 2nd digit only | $ 2 |
| 3rd digit only | $ 1 |

| | YOUR NUMBERS | |
|---|---|---|
| GAME 1 | 1 one, 8 eight, 9 nine | |
| GAME 2 | 3 three, 6 six, 7 seven | PLAY AGAIN |
| GAME 3 | 3 three, 4 four, 8 eight | PLAY AGAIN |
| GAME 4 | 6 six, 7 seven, 1 one | PLAY AGAIN |

WIN UP TO $10,000!

FIG. 6

COMBINATION SCRATCH TICKET AND ON-LINE GAME TICKET

RELATED APPLICATION

The present application is a Divisional Application of U.S. application Ser. No. 11/436,166 having a filing date of May 17, 2006.

BACKGROUND OF THE INVENTION

1. Field of the Invention

The invention relates in general to lottery and promotional tickets or games, and more particularly to an instant win scratch-off lottery or promotional game ticket that may also be used to access or purchase an on-line lottery or promotional game.

2. Description of the Related Art

Scratch-off or instant win lottery tickets have been a staple of the lottery industry for decades. They have been enjoyed by billions of players over the world for years. Innovations in instant win ticket game design have sustained the product and allowed for growth. However, recently the instant win lottery ticket market sales increases have become relatively flat. One method of combating this undesirable trend is to produce higher payout instant win tickets. Most lottery jurisdictions regulate payout percentages by charter and therefore cannot utilize higher payout tickets as a means of increasing sales.

It is therefore desirable to develop a new methodology of marketing instant win lottery tickets where the player perceives added value independent of increases in payout percentages. It is to such a system and methodology the present is primarily directed.

SUMMARY OF THE INVENTION

The novel play style and game ticket of the present invention provides the opportunity to use an instant win scratch-off style game ticket for providing an on-line ticket with predetermined game entry indicia as a prize in the scratch game, or for use in up-selling on-line games in association with the sale of the known types of scratch ticket games.

In one embodiment, there is disclosed a method of implementing a secondary lottery game with a first instant lottery game in an instant lottery game. The method includes issuing an instant lottery ticket having a first instant lottery game to a player, if the first instant win lottery game is a winner, awarding a first prize the player, determining if the player is entitled to receive an entry to a secondary lottery game with predetermined secondary lottery game indicia based on the first instant win lottery game, entering the player in the secondary lottery game to the player if the player is entitled, determining if the player is a winner in the secondary lottery game, and awarding a second prize to the player if the player is a winner in the secondary lottery game.

In another embodiment, there is provided a ticket for an instant lottery game. The ticket includes a substrate, a set of player indicia placed on the top of the substrate and covered by a removable material, a set of instant lottery game indicia placed on the top of the substrate and covered by the removable material, and a bonus indicia placed on the top of the substrate and covered by the removable material. The bonus indicia indicating if a player is eligible for entry into a secondary lottery game with predetermined secondary lottery game indicia. If the set of player indicia matches the set of game indicia according to a predefined criteria, then a predefined prize is awarded to a player. If the bonus indicia indicates entry into a secondary lottery game, the player is entered into the secondary lottery game.

Other objects, features, and advantages of the present invention will become apparent after review of the Brief Description Of The Drawings, Detailed Description Of The Invention, and Claims.

BRIEF DESCRIPTION OF THE DRAWINGS

FIG. 3 is an illustration of an alternate embodiment of the ticket of FIG. 1 with the scratch off layer removed that does provide an on-line ticket as a game prize with a set for predetermined numbers for entry into the on-line game.

FIG. 5 is an illustration of the ticket of FIG. 4 with the scratch off layer removed and which wins an on-line ticket as a game prize with the indicated numbers as entries.

FIG. 6 is an illustration of the ticket of FIG. 4 with the scratch off layer removed and which wins a game prize.

DETAILED DESCRIPTION OF THE INVENTION

Figure 1:
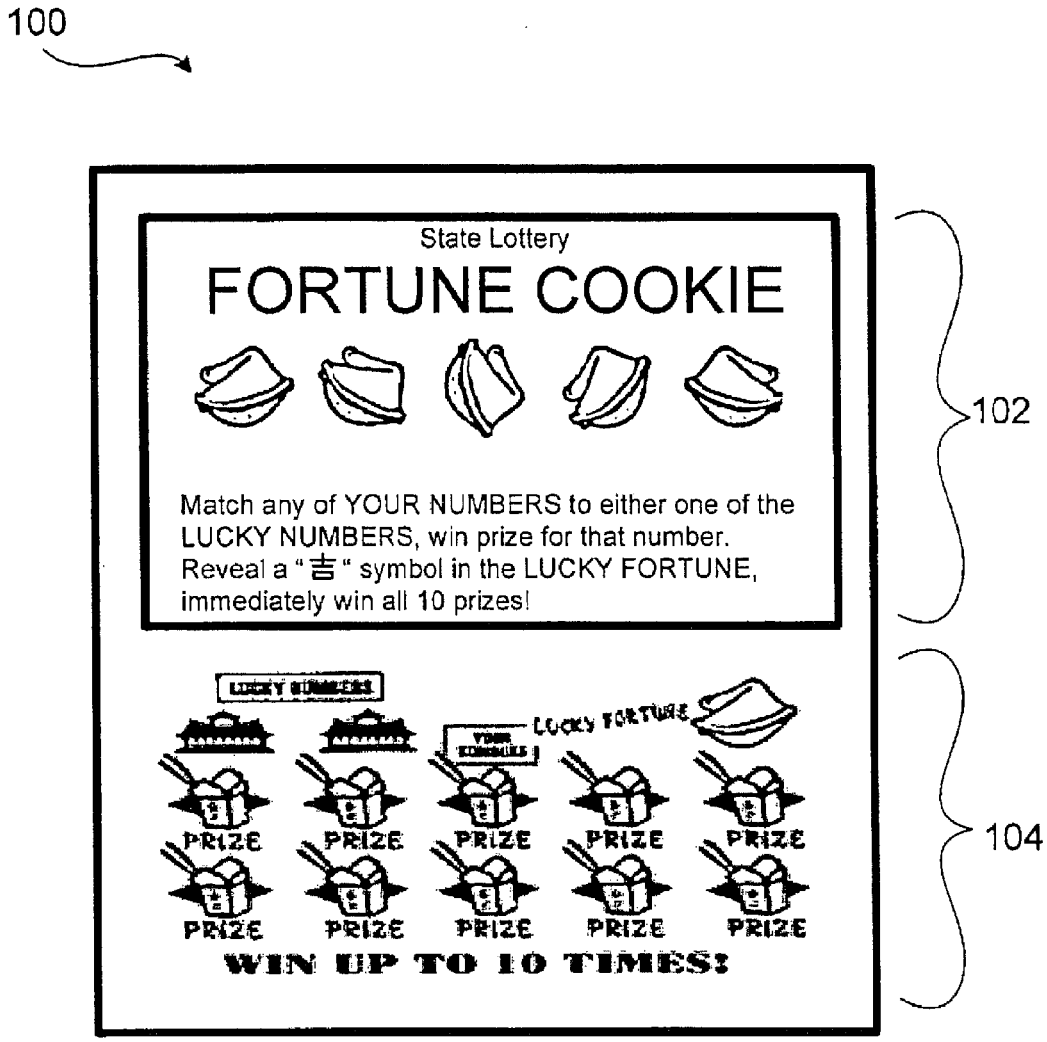
FIG. 1 is an illustration of a game ticket of the present invention on which the scratch off layer of the ticket has not yet been removed.

Referring now to the drawings, information programmed and printed on a scratch-off lottery or promotional game ticket can be read by a lottery terminal. Based on the information contained in the scratch ticket and its unique barcode, the lottery terminal can award and generate a ticket for a separate online game such as Lotto, a Pick 3 game, or other terminal based games.

FIG. 1 illustrates one instant lottery ticket 100 according to the invention. The instant lottery ticket 100 is composed of a substrate of generally paper or other suitable materials. The instant lottery ticket 100 has two areas: theme area 102 and play area 104. The instant lottery ticket 100 generally carries a theme, which may be a sport game, auto racing, etc. The instant lottery ticket 100 is shown with a Chinese fortune cookie theme and basic instructions in its theme area 102. The play area 104 generally includes game information covered by a removable material. The game information is printed on the substrate and covered by latex or other suitable removable materials.

Figure 2:
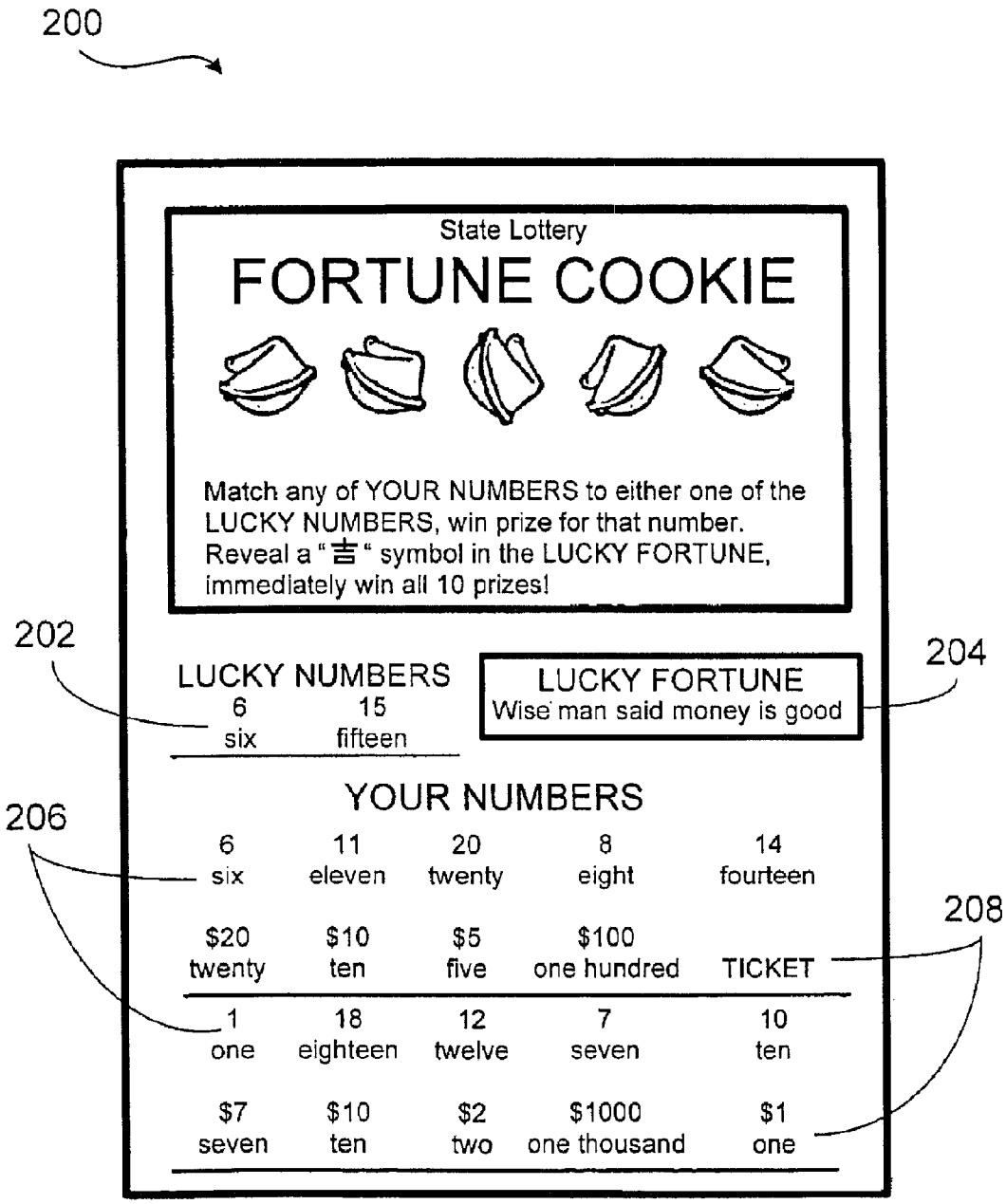
FIG. 2 is an illustration of the ticket of FIG. 1 with the scratch off layer removed and which does not provide an on-line ticket as a game prize.

In one embodiment illustrated in FIG. 2, the game information in the "Fortune Cookie" ticket 200 has been uncovered. The game information includes a pair of LUCKY NUMBERS 202, a lucky fortune 204, a plurality of player numbers (YOUR NUMBERS) 206, and a plurality of prizes 208. The lucky fortune 204 will contain either a fortune or six "lucky numbers." For tickets that contain "lucky fortune numbers," the player, besides winning prizes if there is a match between the LUCKY NUMBERS 202 and player number 206, can redeem the scratch ticket 200 for a Lotto ticket, referring here to as an on-line lottery or promotional game, with the numbers to be played as marked on the scratch ticket. In the example of FIG. 2, the LUCKY NUMBERS 206 are six and fifteen and player numbers are six, eleven, twenty, eight, fourteen, one, eighteen, twelve, seven, and ten. There is a match on number six and the prize associated with number six is twenty ($20) dollars. The lucky fortune 204 reveals a fortune, So the ticket 200 entitles the player to win twenty dollars. If the LUCKY NUMBERS 206 were fourteen and fifteen, the player can redeem the ticket 200 for another ticket.

FIG. 3 illustrates a ticket 300 similar to the ticket 200 except that the lucky fortune 304 reveals a set of lucky fortune numbers as predetermined game indicia for entry into the on-line lottery. Besides redeeming the ticket 300 for twenty dollar prize for matching number six, the player may also redeem the ticket 300 for a terminal based lottery ticket, such as Lotto. The Lotto ticket will contain the lucky fortune numbers shown on FIG. 3. Once redeemed, the player will receive a Lotto ticket with the numbers, 12, 36, 4, 15, 22, and 9 entered into the next on-line Lotto game drawing.

In other embodiments of the invention, the theme may include "Instant Pick 3" or "Instant Lotto" type games, for example. In addition to a regular play area dedicated to playing a scratch-off lottery ticket, there may be something that makes the numbers "live." For example, "Your Numbers" on a ticket might be 3-4-6, i.e. the predetermined on-line game indicia. While there may not be a match between the "Your Numbers" and numbers printed in the scratch-off version, there is a bonus area and if the bonus area reveals a winner, "Your Numbers" on the ticket then become "live" and can be redeemed for an actual Pick 3 ticket with numbers 3-4-6 shown in the drawings. A separate ticket for entry into the secondary lottery game can also be issued by a ticket vending machine, such ticket printing machines being well known in the art.

Figure 4:
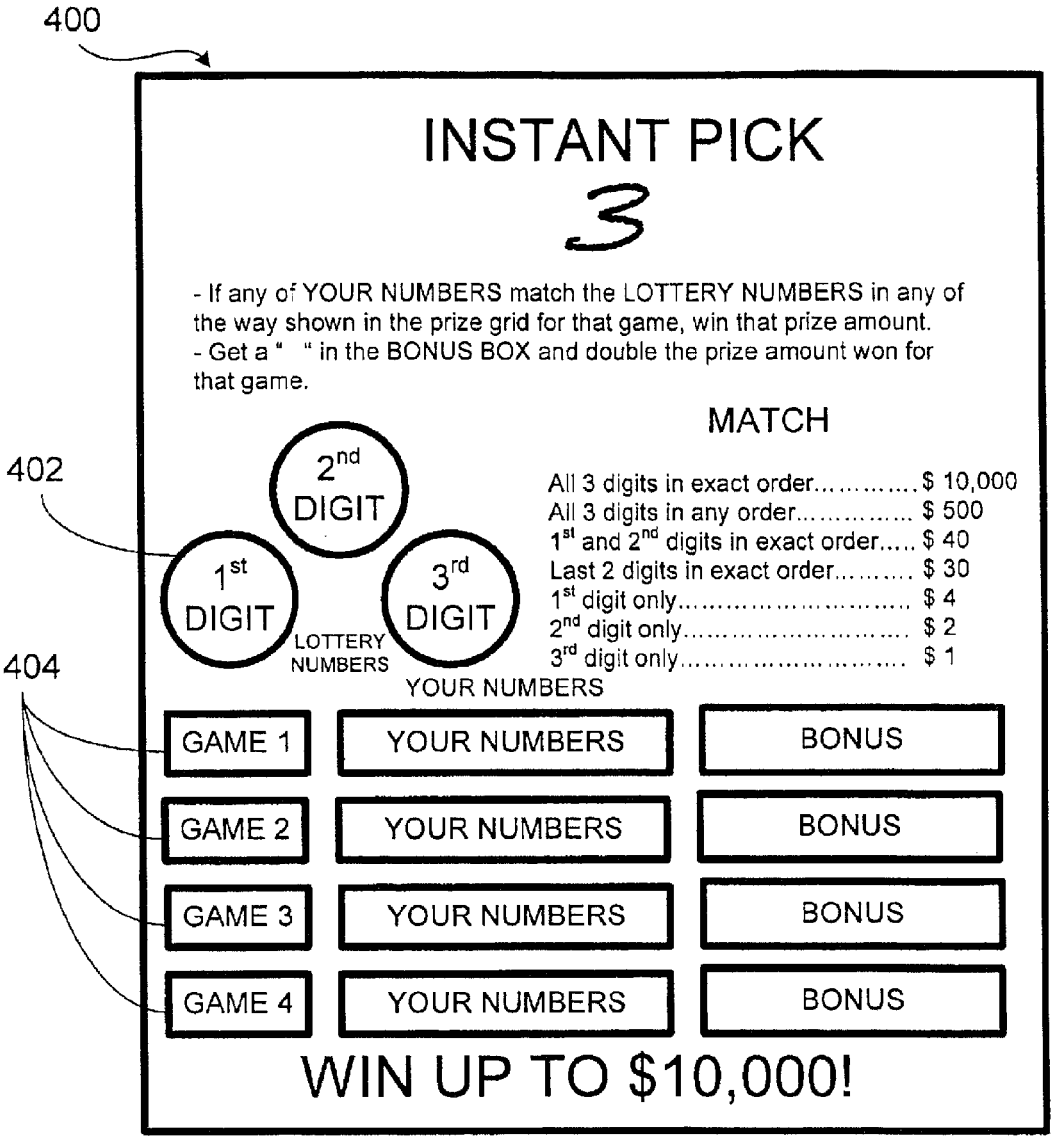
FIG. 4 is an illustration of a second game ticket of the present invention on which the scratch off layer of the ticket has not yet been removed.

FIG. 4 illustrates another instant lottery ticket 400 according to another embodiment of the invention. The theme for this embodiment is "Pick 3" and three numbers 402 are assigned to this lottery ticket 400. The player is provided with four games, which means four opportunities to win. The instant lottery ticket 400 also provides four "bonus" winning chances to the player. Though "Pick 3" and four games are provided with the instant lottery ticket shown in FIG. 4, those skilled in the art will appreciate other games and different winning opportunities may be provided with an instant lottery ticket.

FIG. 5 illustrates an instant lottery ticket of FIG. 4 with game information uncovered. The "Pick 3" numbers are "259," and four game numbers for the player are "187," "367," "348," and "671." The player did not win anything from the "Pick 3." However, from the bonus area, an "ENTRY" is shown beside "348" and the player is then entitled to win an on-line "Pick 3" ticket with numbers "348" for the next drawing.

FIG. 6 illustrates another instant lottery ticket of FIG. 4 with game information uncovered. The "Pick 3" numbers are "259," and four game numbers for the player are "189," "367," "348," and "671." There is a match on the third digit in game 1; therefore the player is entitled $1. However, because there is a special symbol in the bonus area, the prize for the player is doubled.

Figure 7:
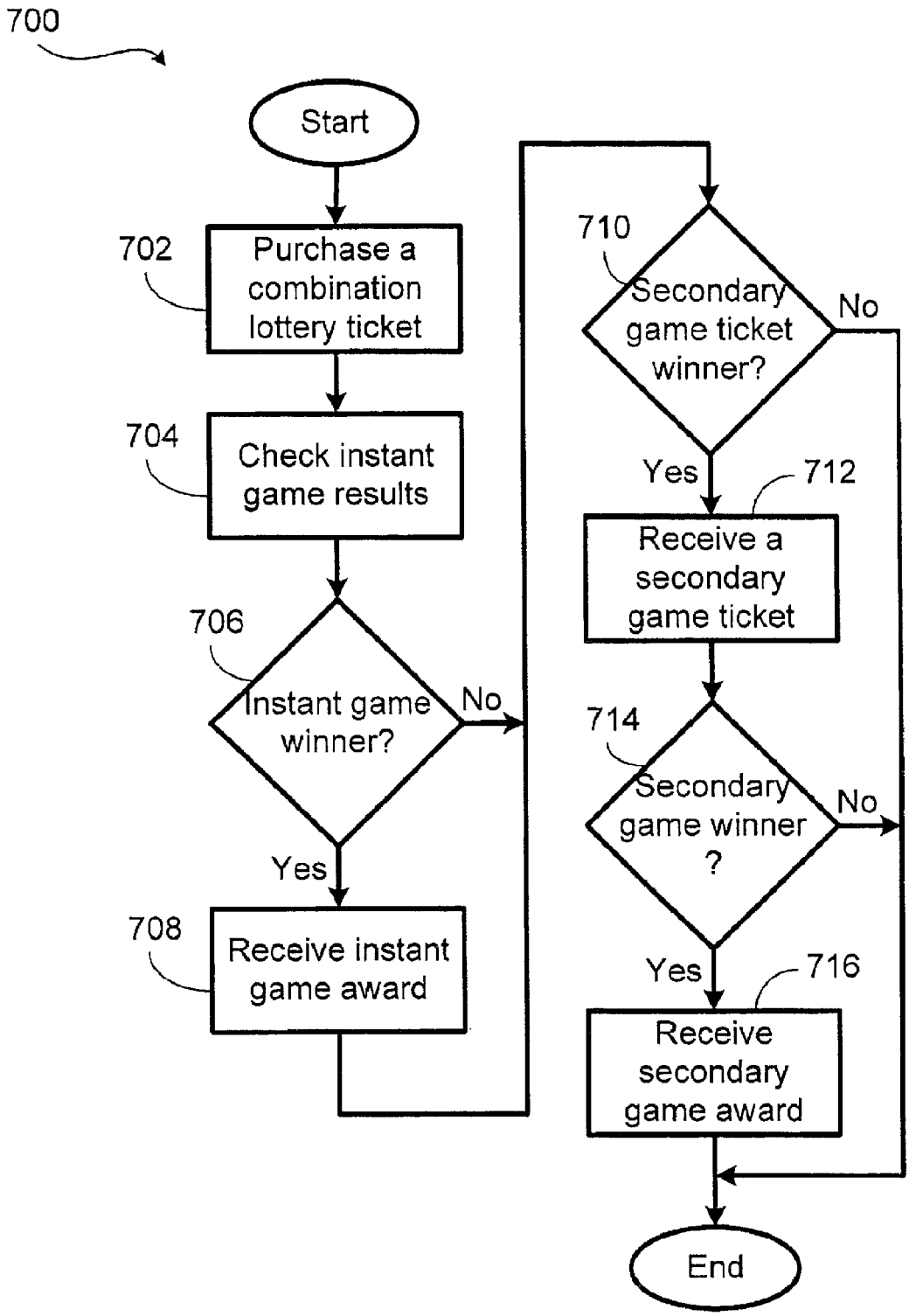
FIG. 7 is an illustration of a process for playing a lottery game according to the invention.

FIG. 7 illustrates a process 700 for playing an instant lottery game according to the invention. The player purchases an instant lottery ticket from a retailer of lottery tickets, step 702, and scratch off the removable material to reveal the game information, step 704. By removing the removable material, the player can verify whether he is winner of an instant game, step 706. The information can be captured from the ticket by scanning means or other data collection as known in the art. If he is a winner, he can redeem the ticket for the prize with the Lottery Authority, step 708. Besides being an instant game winner, the player may also be a winner for a secondary game ticket, step 710. If he is a winner for a secondary game ticket, the player can redeem the instant lottery ticket for a ticket for the secondary game, step 712, having the predetermined game indicia as described above. After he receives the ticket for the secondary lottery game, he can check whether he is a winner at the next drawing of the secondary lottery game, step 714. If he is a winner for the secondary lottery game, he can receive the prize for the secondary lottery game from the Lottery Authority. Thus, according to the present invention, the player has the chance to winning a secondary lottery game with the purchase of an instant lottery game.

The same concept works for Lotto, Cash Lotto, or any other terminal based game. Although several preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments of the inventions are intended to be included within the scope of the appended claims. Moreover, although specific terms are employed herein, as well as in the claims, they are used in a generic and descriptive sense only, and not for the purposes of limiting the described invention.

In the context of FIG. 7, certain steps of the method may be implemented, for example, by operating a computer to execute a sequence of machine-readable instructions. The instructions can reside in various types of signal-bearing or data storage primary, secondary, or tertiary media. The media may comprise, for example, RAM (not shown) accessible by, or residing within, the components of the wireless network. Whether contained in RAM, a diskette, or other secondary storage media, the instructions may be stored on a variety of machine-readable data storage media, such as DASD storage (e.g., a conventional "hard drive" or a RAID array), magnetic tape, electronic read-only memory (e.g., ROM, EPROM, or EEPROM), flash memory cards, an optical storage device (e.g. CD-ROM, WORM, DVD, digital optical tape), paper "punch" cards, or other suitable data storage media including digital and analog transmission media.

While the invention has been particularly shown and described with reference to one embodiment thereof, it will be understood by those skilled in the art that various changes in form and detail may be made without departing from the spirit and scope of the present invention as set forth in the following claims. Though the method in FIG. 7 is illustrated in sequential steps, those skilled in the art will appreciate the different sequences may also be used to implement the invention. Furthermore, although elements of the invention may be described or claimed in the singular, the plural is contemplated unless limitation to the singular is explicitly stated.

What is claimed is:

1. An instant lottery game ticket configured for play of a first instant lottery game and a secondary subsequent lottery game, comprising: a substrate, player indicia on said substrate for play of said first instant lottery game, said player indicia covered by a removable material;

entry indicia on said substrate for potential entry to said secondary lottery game that is played by issuing a separate lottery game ticket to the player, said entry indicia being unique to said instant lottery game ticket and covered by a removable material;

said entry indicia indicating whether a player is entitled to a separate lottery game ticket for play of said subsequent secondary lottery game wherein the player is only allowed entry into the secondary lottery game via the entry indicia provided in association with the first instant lottery game; and in the event that the player is entitled to a separate lottery game ticket, said entry indicia comprising a player's unique entry indicia in said subsequent secondary lottery game that distinguishes said separate lottery game ticket from other lottery game tickets in the secondary lottery game such that the player's unique entry indicia on the first instant lottery game ticket are used to determine the results of the subsequent secondary lottery game.

2. The instant lottery game ticket as in claim 1, wherein the player is entitled to entry in said subsequent secondary lottery game based solely on said revealed player's unique entry indicia without regard to results of said first instant win lottery game.

3. The instant lottery game ticket as in claim 1, wherein for entry in said secondary lottery game, said player indicia must provide a win for the player in said first instant win lottery game.

4. The instant lottery game ticket as in claim 1, wherein said player's unique entry indicia comprises a set of numbers for entry in said subsequent secondary lottery game.

5. The instant lottery game ticket as in claim 4, wherein said subsequent secondary lottery game is an on-line lottery game.

6. A combination of tickets for play of an instant lottery game and a subsequent secondary lottery game, said combination comprising:

a plurality of instant lottery game tickets, each of said instant lottery game ticket further comprising a substrate, player indicia on said substrate for play of said first instant lottery game, said player indicia covered by a removable material;

entry indicia on said substrate for potential entry to said subsequent secondary lottery game, said entry indicia covered by a removable material and indicating whether said instant lottery game ticket qualifies for entry in said subsequent secondary lottery game and, if qualified, a player's unique entry indicia being used for the secondary lottery game wherein the player is only allowed entry into the secondary lottery game via the player's unique entry indicia provided in association with the first instant lottery game; and a respective separate lottery ticket issued to the player for play of said subsequent secondary lottery game associated with said qualifying instant lottery game tickets, said lottery ticket comprising a player's entry in said secondary lottery game that corresponds to said player's unique entry indicia from the player's said instant lottery game ticket that distinguishes said separate lottery game ticket from other lottery game tickets in the secondary lottery game such that the player's unique entry indicia from the first instant lottery game are used to determine the results of the subsequent secondary lottery game.

7. The combination of tickets as in claim 6, wherein the player is entitled to entry in said subsequent secondary lottery game based solely on said revealed player's unique entry indicia without regard to results of said instant win lottery game.

8. The combination of tickets as in claim 6, wherein for entry in said secondary lottery game, said player indicia must provide a win for the player in said instant win lottery game.

9. The combination of tickets as in claim 6, wherein said player's unique entry indicia comprises a set of numbers for entry in said subsequent secondary lottery game.

* * * * *